US011022126B2

(12) United States Patent
Yanagisawa et al.

(10) Patent No.: US 11,022,126 B2
(45) Date of Patent: Jun. 1, 2021

(54) ROTARY MACHINE

(71) Applicant: MITSUBISHI HEAVY INDUSTRIES COMPRESSOR CORPORATION, Tokyo (JP)

(72) Inventors: Shin Yanagisawa, Tokyo (JP); Akihiro Nakaniwa, Tokyo (JP); Eiichi Yanagisawa, Tokyo (JP); Kazutoshi Yoko, Tokyo (JP); Daisuke Hirata, Hiroshima (JP); Takanori Matsueda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 335 days.

(21) Appl. No.: 16/089,067

(22) PCT Filed: Mar. 2, 2017

(86) PCT No.: PCT/JP2017/008277
§ 371 (c)(1),
(2) Date: Sep. 27, 2018

(87) PCT Pub. No.: WO2017/169496
PCT Pub. Date: Oct. 5, 2017

(65) Prior Publication Data

US 2020/0300253 A1 Sep. 24, 2020

(30) Foreign Application Priority Data

Mar. 28, 2016 (JP) ..... JP2016-063786

(51) Int. Cl.
*F04D 17/12* (2006.01)
*F04D 29/42* (2006.01)
(Continued)

(52) U.S. Cl.
CPC ..... *F04D 17/122* (2013.01); *F04D 29/4206* (2013.01); *F04D 29/083* (2013.01);
(Continued)

(58) Field of Classification Search
CPC ..... F04D 17/122; F04D 29/4206; F05D 2250/52; F05D 2250/70
See application file for complete search history.

(56) References Cited

U.S. PATENT DOCUMENTS 4,493,611 A * 1/1985 Funakoshi ..... F01D 9/026 415/199.1
4,715,778 A * 12/1987 Katayama ..... F04D 17/122 415/104
(Continued)

FOREIGN PATENT DOCUMENTS

CN 104454652 A 3/2015
JP S52-119704 A 10/1977
(Continued)

OTHER PUBLICATIONS

Extended European Search Report in counterpart European Application No. 17774041.2 dated Feb. 18, 2019 (7 pages).
(Continued)

*Primary Examiner* — Brian P Wolcott
(74) *Attorney, Agent, or Firm* — Osha Bergman Watanabe & Burton LLP

(57) ABSTRACT

A rotary machine includes: a casing; a rotor that includes a rotatable rotary shaft located inside the casing, and a plurality of stages of impellers fixed to an outer periphery of the rotary shaft; a diaphragm group including diaphragms that are respectively provided in the plurality of stages of the impellers; gas flow paths provided respectively corresponding to the impellers and through which process gas to be compressed flows; and a discharge volute connected to the
(Continued)

gas flow paths. The discharge volute is provided to expand inward in an axis line direction of the casing.

7 Claims, 4 Drawing Sheets

(51) Int. Cl.
*F04D 29/08* (2006.01)
*F04D 29/28* (2006.01)
*F04D 29/44* (2006.01)

(52) U.S. Cl.
CPC ..... *F04D 29/284* (2013.01); *F04D 29/444* (2013.01); *F05D 2250/52* (2013.01); *F05D 2250/70* (2013.01)

(56) References Cited

U.S. PATENT DOCUMENTS 5,363,674 A 11/1994 Powell
7,871,239 B2 * 1/2011 Sorokes ..... F04D 17/125 415/116
8,580,002 B2 * 11/2013 Lardy ..... B01D 45/00 55/317
2007/0183892 A1 8/2007 Sorokes
2009/0044548 A1 2/2009 Masoudipour et al.
2012/0183395 A1 * 7/2012 Komor ..... F04D 29/444 415/208.1
2014/0133959 A1 5/2014 Iurisci et al.
2017/0306981 A1 10/2017 Liu et al.

FOREIGN PATENT DOCUMENTS

JP S63-170591 A 7/1988
JP 2014-521016 A 8/2014
WO 2011/036459 A1 3/2011
WO 2016/042004 A1 3/2016

OTHER PUBLICATIONS

International Preliminary Report on Patentability issued in corresponding International Application No. PCT/JP2017/008277 dated Oct. 11, 2018 (7 pages).
International Search Report issued in corresponding International Application Na PCT/JP2017/008277 dated Apr. 25, 2017 (1 page).
Notification of Reasons for Refusal issued in corresponding Japanese Patent Application No. 2018-508844, dated Sep. 3, 2019 (10 pages).

* cited by examiner

ROTARY MACHINE

TECHNICAL FIELD

The present invention relates to a rotary machine.

BACKGROUND ART

A centrifugal compressor as a rotary machine generally includes a rotor that includes a rotary shaft, and a stationary body that includes a casing body provided around the rotor, and compresses, by impellers provided on the rotor, gas sucked in from a suction port and discharges the compressed gas from a discharge port.

As a type of the casing body, in addition to a vertical divisional barrel type, there is a horizontal divisional type in which an upper half casing and a lower half casing dividable in a vertical direction are provided and flanges of the two casings are fastened by bolts.

A centrifugal compressor for a nitric acid plant sucks in process gas at about 50° C.; however, the temperature of the process gas is raised to about 200° C. along with the pressure rise.

At this time, in the horizontal divisional centrifugal compressor, thermal deformation occurs due to temperature difference from an outlet of the process gas to a bearing, in addition to temperature difference from an inlet to the outlet of the process gas. As a result, division surfaces of the two divided casings may be separated.

Patent Literature 1 discloses, as a technique to prevent leakage of high-pressure gas from the division surfaces of the upper half casing and the lower half casing, a flange structure of the casing body including the upper half casing and the lower half casing. In the structure, a groove is provided on an upper flange portion of the upper half casing, and a protrusion to be assembled into the groove of the upper flange portion by spigot joint is provided on a lower flange portion of the lower half casing.

In Patent Literature 1, if separation occurs on the division surfaces of the casing, the gas is easily collected at an irregular part of the spigot structure, and corrosion may occur on the upper flange portion and the lower flange portion due to the collected gas. Accordingly, it is desirable to eliminate irregularity from the contact surface of each of the upper flange portion and the lower flange portion.

CITATION LIST

Patent Literature

Patent Literature 1: JP 52-119704 A

SUMMARY OF INVENTION

Technical Problem

Accordingly, an object of the present invention is to provide a rotary machine that makes it possible to prevent leakage of the high-pressure gas from the division surfaces without providing irregularity on the contact surface of each of the upper flange portion and the lower flange portion.

Solution to Problem

A rotary machine according to the present invention includes: a casing; a rotor that includes a rotatable rotary shaft located inside the casing, and a plurality of stages of impellers fixed to an outer periphery of the rotary shaft; a diaphragm group including diaphragms that are respectively provided in the plurality of stages of the impellers; gas flow paths provided respectively corresponding to the impellers and through which process gas to be compressed flows; and a discharge volute connected to the gas flow paths. The discharge volute is provided to expand inward in an axis line direction of the casing.

In the rotary machine according to the present invention, the discharge volute preferably expands inward in the axis line direction, relative to a position on an extension line of a flow of the process gas flowing out from the impeller in a last stage.

In the rotary machine according to the present invention, the casing preferably includes an upper half casing and a lower half casing, the upper half casing preferably includes an upper half flange portion, an upper outer peripheral portion of an upper half wall portion connected to the upper half flange portion, and a pedestal that is adjacent to the upper half wall portion in the axis line direction and is higher in height than the upper half flange portion, the lower half casing preferably includes a lower half flange portion and a lower outer peripheral portion of a lower half wall portion connected to the lower half flange portion, and the upper half flange portion and the lower half flange portion are preferably fixed by a first fixing portion.

In the rotary machine according to the present invention, a second fixing portion preferably fixes the pedestal and the lower outer peripheral portion by a through bolt.

In the rotary machine according to the present invention, the first fixing portion preferably fixes the upper half flange portion and the lower half flange portion by a stud bolt.

In the rotary machine according to the present invention, a position of a seat surface of the through bolt that fixes the pedestal and the lower outer peripheral portion is preferably higher than a position of a seat surface of the stud bolt.

Advantageous Effects of Invention

According to the present invention, it is possible to prevent leakage of the high-pressure gas from the division surfaces without providing irregularity on the contact surface of each of the upper flange portion and the lower flange portion.

DESCRIPTION OF EMBODIMENTS

An embodiment of the present invention is described below with reference to FIG. 1 and FIG. 2.

Figure 1:
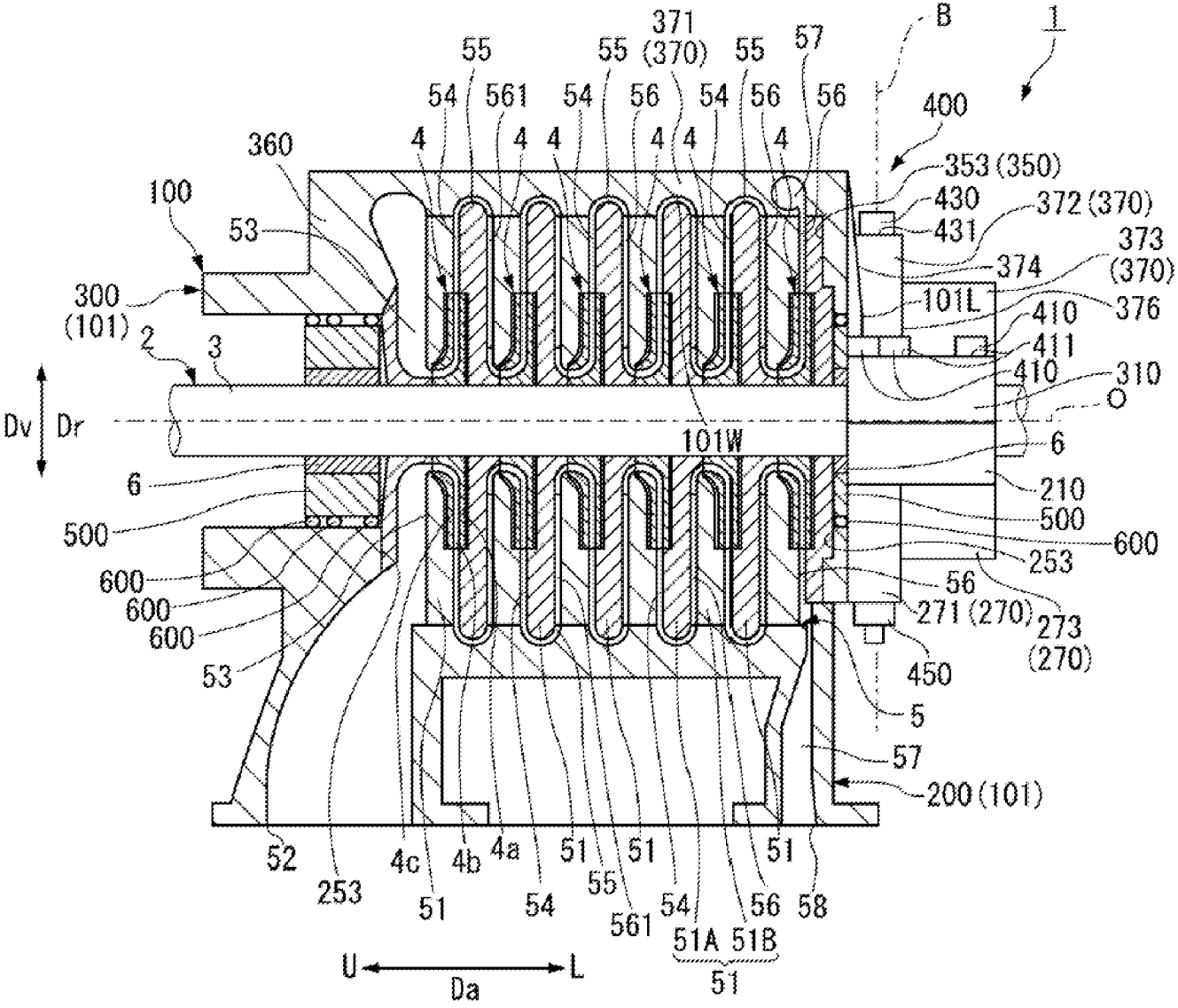
FIG. 1 illustrates a schematic configuration of a centrifugal compressor according to an embodiment of the present invention, and is a vertical cross-sectional view taken along a line A-A of FIG. 2.
Figure 2:
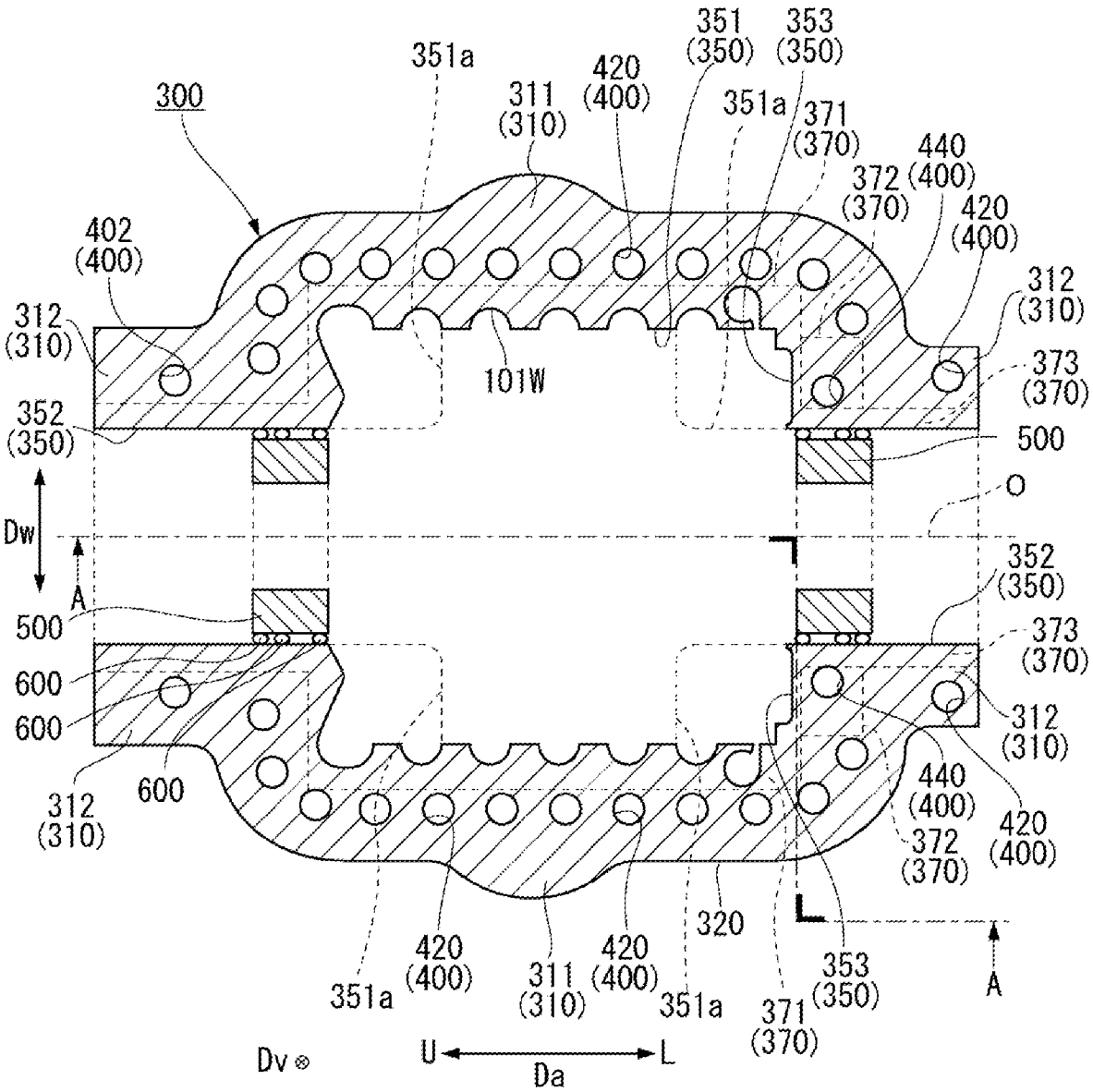
FIG. 2 is a diagram illustrating an upper half casing broken at a position near a shaft, according to the embodiment of the present invention.

As illustrated in FIG. 1, a rotary machine according to the present embodiment is a uniaxial multistage centrifugal compressor 1 including a plurality of impellers 4. The centrifugal compressor 1 includes a rotor 2, a diaphragm group 5, a sealing device 6, and a casing assembly 100.

The centrifugal compressor 1 is characterized in that types and positions of bolts fixing a lower half casing 200 and an upper half casing 300 are diversified to secure surface pressure up to end parts of flanges.

The rotor 2 rotates around an axis line O. The rotor 2 includes a rotary shaft 3 that extends along the axis line O and serves as a rotor main body, and the plurality of impellers 4 that rotate together with the rotary shaft 3.

The rotary shaft 3 is coupled to a driving source such as a motor. The rotary shaft 3 is rotationally driven by the driving source. The rotary shaft 3 includes a columnar shape around the axis line O, and extends in an axis line direction Da in which the axis line O extends. Both ends of the rotary shaft 3 in the axis line direction Da are rotatably supported by unillustrated bearings.

The impellers 4 are fixed to an outer peripheral part of the rotary shaft 3. The impellers 4 rotate together with the rotary shaft 3 to compress process gas (working fluid) as a compression target, with use of centrifugal force. The impellers 4 are provided in a plurality of stages in the axis line direction Da with respect to the rotary shaft 3. The impellers 4 according to the present embodiment are disposed between the bearings disposed on both sides in the axis line direction Da with respect to the rotary shaft 3. Each of the impellers 4 is a so-called closed impeller that includes a disk 4*a*, a blade 4*b*, and a cover 4*c*. A flow path through which the process gas flows is defined by the disk 4*a*, the blade 4*b*, and the cover 4*c* inside each of the impellers 4. The plurality of impellers 4 arranged to face the same direction along the axis line direction Da configure an impeller group. The centrifugal compressor 1 according to the present embodiment includes one impeller group.

The diaphragm group 5 covers the rotor 2 from outside. The diaphragm group 5 includes a plurality of diaphragms 51 (internal casings) that are arranged in the axis line direction Da, respectively corresponding to the impellers 4 in the plurality of stages. The diaphragms 51 each have a diameter larger than a diameter of each of the impellers 4, and are arranged so as to be stacked in the axis line direction Da. The diaphragms 51 each include members 51A and 51B that are coupled to each other through a return vane 561. The impellers 4 are respectively accommodated on inner peripheral sides of the diaphragms 51. The diaphragms 51 and an inner wall 101W of a casing 101 define flow paths through which the process gas flows, together with the flow paths of the impellers 4.

Here, the flow paths configured by the diaphragms 51 and the inner wall 101W are specifically described in order from upstream side U that is one side in the axis line direction Da. In the present embodiment, a suction port 52, a suction flow path 53, a plurality of diffuser flow paths 54, a plurality of curved flow paths 55, a plurality of return flow paths 56, a discharge volute 57, and a discharge port 58 are provided in order from the upstream side U through which the process gas flows.

Note that the upstream side U and downstream side L of the flow of the process gas used in the present embodiment indicate relative positional relationship.

The suction port 52 causes the process gas to flow into the suction flow path 53 from the outside. The suction flow path 53 causes the process gas that has flowed from the outside of the casing 101 described later, to flow into the casing 101.

The suction flow path 53 causes the process gas to flow into the impeller 4 disposed on most upstream side U out of the plurality of impellers 4 arranged in the axis line direction Da. The suction flow path 53 is an annular space that extends inward in a radial direction Dr from the suction port 52. The suction flow path 53 is connected to an inlet that faces the upstream side U of the impeller 4 while a direction of the suction flow path 53 is gradually changed from the radial direction Dr to the downstream side L that is the other side of the axis line direction Da. The radial direction Dr is a direction orthogonal to the axis line O.

The process gas that has flowed out from the impellers 4 to the outside in the radial direction Dr flows into the diffuser flow paths 54. The diffuser flow paths 54 are respectively connected to outlets of the impellers 4 each facing the outside in the radial direction Dr. The diffuser flow paths 54 extend outward in the radial direction Dr respectively from the outlets of the impellers 4, and are respectively connected to the curved flow paths 55.

The curved flow paths 55 change a flowing direction of the process gas from a direction toward the outside in the radial direction Dr to a direction toward the inside in the radial direction Dr. In other words, as illustrated in FIG. 1, the curved flow paths 55 are flow paths each including a U-shaped vertical cross-section. The curved flow paths 55 are configured by outer peripheral surfaces of the diaphragms 51 outside in the radial direction and an inner peripheral surface of an upper outer peripheral portion 371 of the casing 101 described later.

The return flow paths 56 cause the process gas that has flowed through the curved flow paths 55, to flow into the impellers 4 in next stages, respectively. The return flow paths 56 are each gradually increased in width while extending inward in the radial direction Dr. The return flow paths 56 change the flowing direction of the process gas toward the downstream side in the axis line direction Da, inside the diaphragm group 5 in the radial direction Dr. In the return flow paths 56, a plurality of return vanes 561 are provided with intervals in a circumferential direction.

As illustrated in FIG. 1, the discharge volute 57 is formed in an annular shape over the upper half casing 300 and the lower half casing 200 described later. In a comparative example illustrated in FIG. 3 and FIG. 4, the discharge volute 57 is formed so as to expand outward in the axis line direction Da on both of the upper side and the lower side. In contrast, in the present embodiment, the discharge volute 57 is formed so as to expand inward in the axis line direction Da.

Figure 3:
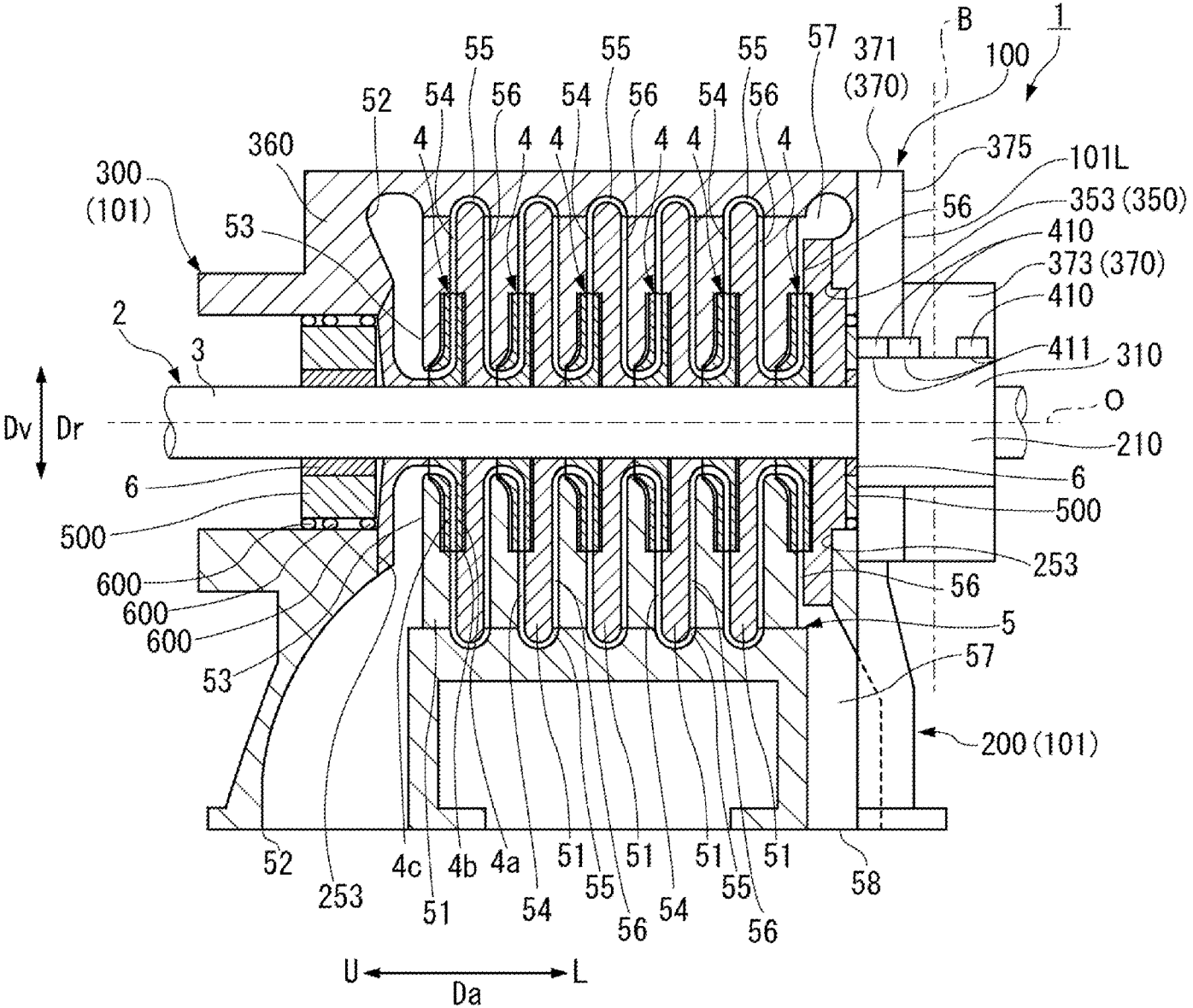
FIG. 3 illustrates a schematic configuration of a centrifugal compressor according to a comparative example, and is a vertical cross-sectional view taken along a line A-A of FIG. 4.
Figure 4:
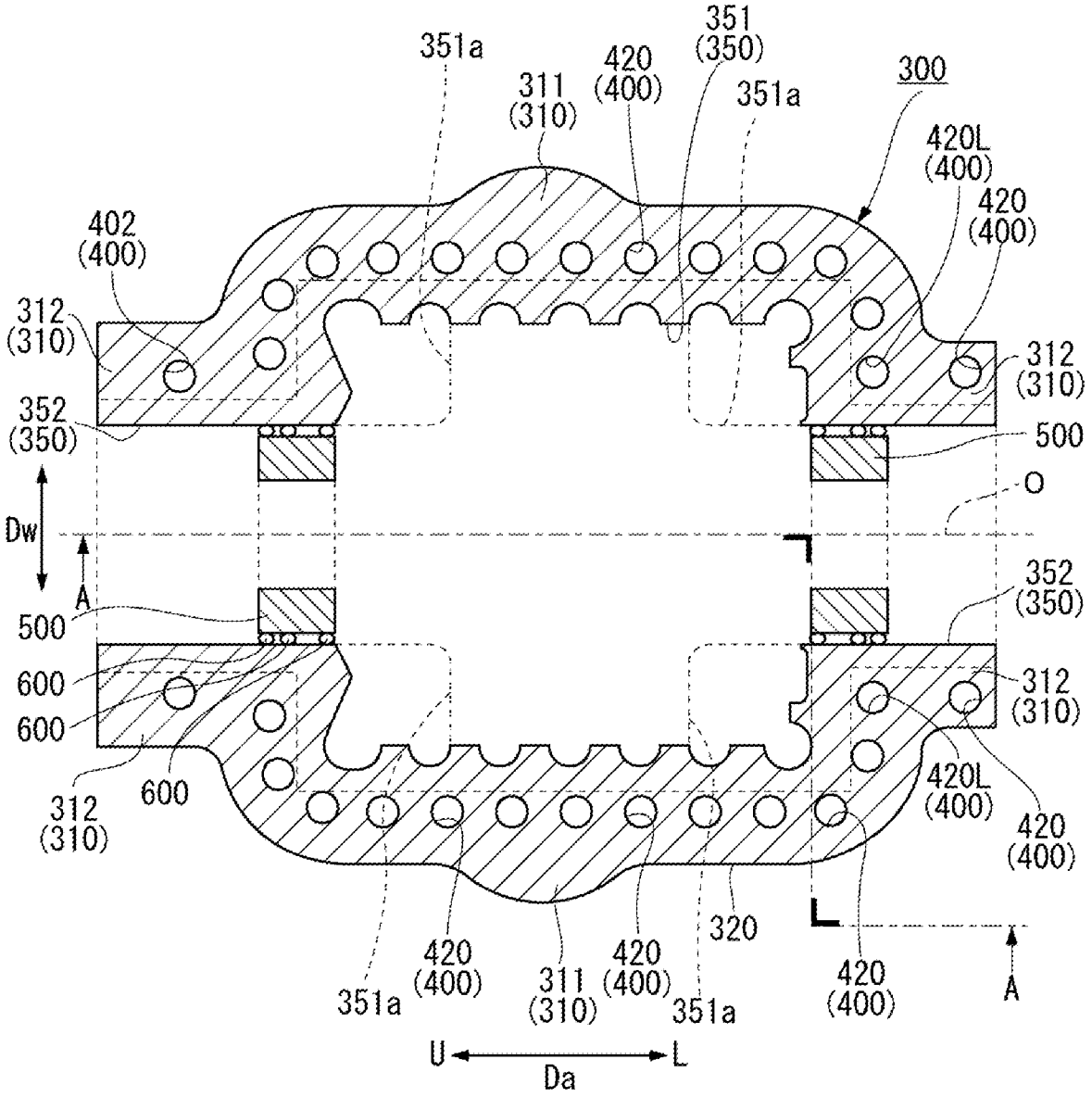
FIG. 4 is a diagram illustrating an upper half casing of the centrifugal compressor broken at a position near a shaft, according to the comparative example of FIG. 3.

As compared with the comparative example illustrated in FIG. 3 and FIG. 4, it is possible to avoid the structure in which the casing 101 expands outward in the axis line direction Da because of the expanding (swelling) direction of the discharge volute 57 in the present embodiment. Unlike the comparative example illustrated in FIG. 3 and FIG. 4, an upper half wall portion 370 includes a structure including a pedestal 372 in addition to the upper outer peripheral portion 371 and an upper bearing accommodating portion 373. The pedestal 372 is lower in height than the upper outer peripheral portion 371, and is higher in height than an upper half flange portion 310. An inclined surface 374 connecting the upper outer peripheral portion 371 and the pedestal 372 is provided on the inside in the axis line direction Da, as compared with a wall surface 375 connecting the upper outer peripheral portion 371 and the upper bearing accommodating portion 373 according to the comparative example illustrated in FIG. 3 and FIG. 4. The inclined surface 374 in FIG. 1 configures an end surface of the upper outer peripheral portion 371 on the downstream side L.

The sealing device 6 suppresses leakage of the process gas from the inside to the outside of the casing 101. The sealing device 6 seals an outer peripheral surface of the rotary shaft 3 over the entire circumference. As the sealing device 6 of the present embodiment, for example, a labyrinth seal is used.

The casing assembly 100 accommodates the rotor 2, the diaphragm group 5, and the sealing device 6. The casing assembly 100 includes the lower half casing 200, the upper half casing 300, a fixing portion 400, a seal housing holder 500, and a sealing member 600.

The lower half casing 200 is fixed to a bottom floor. The lower half casing 200 includes the suction port 52 that opens downward in a vertical direction Dv, and the suction flow path 53 connected to the suction port 52. A part (lower half) of the discharge volute 57 provided in the lower half casing 200 is connected to the discharge port 58 that opens downward in the vertical direction Dv.

The lower half casing 200 is combined with the upper half casing 300 to configure the casing 101.

The casing 101 forms an exterior of the centrifugal compressor 1. The casing 101 includes a cylindrical shape. The casing 101 is formed such that a center axis thereof is coincident with the axis line O of the rotary shaft 3. The casing 101 accommodates the impellers 4 in the plurality of stages and the diaphragm group 5.

In the following, more specific configuration of the casing 101 is described with the upper half casing 300 as an example because the lower half casing 200 and the upper half casing 300 include substantially similar configuration except for installation positions.

The upper half casing 300 includes a half-split shape, and is disposed on the lower half casing 200 as illustrated in FIG. 1. The upper half casing 300 opens downward in the vertical direction Dv.

In this example, the suction port 52 and the discharge port 58 described above are provided in the lower half casing 200 and are not provided in the upper half casing 300. Therefore, a part of the suction flow path 53 provided in the upper half casing 300 and a part of the discharge volute 57 provided in the upper half casing 300 do not communicate with the outside.

The shape of the upper half casing 300 as viewed from below in the vertical direction Dv is substantially the same as the shape of the lower half casing 200 as viewed from above in the vertical direction Dv. As illustrated in FIG. 2, the upper half casing 300 includes the upper half flange portion 310, an upper half accommodating recess 350, and the upper half wall portion 370.

The upper half flange portion 310 is a horizontal surface facing downward in the vertical direction Dv. The upper half flange portion 310 corresponds to a division surface when the casing 101 is divided in a vertical direction.

The upper half flange portion 310 includes paired first upper half flange parts 311 and paired second upper half flange parts 312.

The paired first upper half flange parts 311 are separately provided in a width direction Dw with the axis line O in between as viewed from above in the vertical direction Dv. The first upper half flange parts 311 are flat surfaces extending long in the axis line direction Da. Flange surfaces similar to the first upper half flange parts 311 are provided in the lower half casing 200.

The second upper half flange parts 312 are provided on both sides of the first upper half flange parts 311 in the axis line direction Da. The second upper half flange parts 312 are flat surfaces continuous to the first upper half flange parts 311. The second upper half flange parts 312 are disposed inward of the first upper half flange parts 311 in the width direction Dw as viewed from above in the vertical direction Dv. Flange surfaces similar to the second upper half flange parts 312 are provided in the lower half casing 200.

A plurality of insertion holes 420 into which fixing bolts are respectively inserted are provided in the first upper half flange parts 311 and the second upper half flange parts 312. The insertion holes 420 penetrate through the upper half flange portion 310 in a thickness direction. The insertion holes 420 are provided at positions matched with positions of fixing holes of the lower half casing 200 when the upper half casing 300 is combined with the lower half casing 200.

The upper half wall portion 370 of the upper half casing 300 is recessed upward in the vertical direction Dv from the upper half flange portion 310. The upper half accommodating recess 350 is a space covered with an inner peripheral surface of the upper half wall portion 370 as viewed from below in the vertical direction Dv. When the upper half casing 300 and the lower half casing 200 are combined, an accommodating space that is formed by the upper half accommodating recess 350 and a similar recess provided in the lower half casing 200 and extends around the axis line O is formed inside the casing 101. The members such as the diaphragm group 5 provided in the impellers 4 in the plurality of stages and the sealing device 6 are disposed in the accommodating space. The upper half accommodating recess 350 includes an upper half large-diameter recess 351, an upper half small-diameter recess 352, and an upper half step surface 353.

The upper half large-diameter recess 351 is a space in which the diaphragm group 5 and the like are accommodated, together with a similar space of the lower half casing 200. The upper half large-diameter recess 351 is a space provided around the axis line O. The upper half large-diameter recess 351 is provided on the inside in the width direction Dw so as to be sandwiched between the two first upper half flange parts 311 as viewed from below in the vertical direction Dv. The upper half large-diameter recess 351 includes an upper half corner region 351*a* that is located at a position adjacent to the upper half small-diameter recess 352 in the axis line direction Da, outside the upper half small-diameter recess 352 in the width direction Dw, as viewed from below in the vertical direction Dv.

The upper half small-diameter recess 352 is a space in which the sealing device 6 is accommodated, together with a similar recess of the lower half casing 200. The upper half small-diameter recess 352 is adjacent to the upper half large-diameter recess 351 in the axis line direction Da, and extends in the axis line direction Da. The upper half small-diameter recess 352 is provided on each of both sides of the upper half large-diameter recess 351 in the axis line direction Da. The upper half small-diameter recess 352 is a space formed around the axis line O. The upper half small-diameter recess 352 is provided between the two second upper half flange parts 312 as viewed from below in the vertical direction Dv. The upper half small-diameter recess 352 is smaller in size in the radial direction Dr than the upper half large-diameter recess 351.

The upper half step surface 353 is a surface extending in the radial direction Dr between the upper half large-diameter recess 351 and the upper half small-diameter recess 352 on the downstream side L. The upper half step surface 353 is a part of an inner surface defining the upper half large-diameter recess 351. More specifically, the upper half step surface 353 is a part of the inner surface of the upper half casing 300 facing inward in the axis line direction Da, and a predetermined region on the axis line O side is recessed toward the downstream side L (FIG. 1 and FIG. 2). The upper half step surface 353 is a surface that reaches the upper half flange portion 310 and is continuous to a similar step surface of the lower half casing 200 when the upper half casing 300 and the lower half casing 200 are combined.

The upper half wall portion 370 (FIG. 1 and FIG. 2) includes the upper half accommodating recess 350 and is connected to the upper half flange portion 310 at a peripheral edge. The upper half wall portion 370 includes the upper outer peripheral portion 371 and the upper bearing accommodating portion 373 that has a dimension in the vertical direction Dv smaller than that of the upper outer peripheral portion 371 in side view. The pedestal 372 that is higher in height than the upper half flange portion 310 is provided adjacently to the upper outer peripheral portion 371 in the axis line direction Da. The pedestal 372 is lower in height than the upper outer peripheral portion 371, that is, has a dimension in the vertical direction Dv smaller than that of the upper outer peripheral portion 371 in side view. The upper outer peripheral portion 371 and the pedestal 372 are connected to each other through the inclined surface 374, and the pedestal 372 and the upper bearing accommodating portion 373 are connected to each other through a wall surface 376.

The inclined surface 374 (FIG. 1) gradually inclines more towards the axis line O from the upstream side U toward the downstream side L in the axis line direction Da as the upper half step surface 353 is recessed toward the downstream side L in the axis line direction Da as described above, in order to secure a thickness necessary to withstand pressure during operation of the centrifugal compressor 1.

The upper outer peripheral portion 371 is formed in a semi-cylindrical shape, and the pedestal 372 is formed such that a top surface thereof is substantially parallel to the upper half flange portion 310. As illustrated in FIG. 2, the pedestal 372 is provided on each of both sides of the axis line O in the width direction Dw.

In the pedestal 372, a through hole 440 into which a through bolt 430 is inserted is provided so as to penetrate the pedestal 372 in a vertical direction. The through hole 440 is provided on the inside in the axis line direction Da and on the inside in the width direction Dw, relative to a through hole 420L of FIG. 4 that is located near the seal housing holder 500 on the downstream side L in the comparative example (FIG. 4) similar to the through hole 440. In other words, the through hole 440 is provided near the inclined surface 374 that connects the upper outer peripheral portion 371 and the pedestal 372. The through hole 440 is provided at a position matched with a position of a through hole similarly provided in the lower half casing 200 when the upper half casing 300 is combined with the lower half casing 200.

As illustrated in FIG. 1, the lower half casing 200 includes a lower half wall portion 270 connected to the lower half flange portion 210, as with the upper half wall portion 370 of the upper half casing 300. The lower half wall portion 270 includes a lower outer peripheral portion 271 and a lower bearing accommodating portion 273 that includes a diameter smaller than that of the lower outer peripheral portion 271. The lower outer peripheral portion 271 and the lower bearing accommodating portion 273 are connected, through a step surface, in this order from the upstream side U to the downstream side L.

Further, the lower half casing 200 includes, on the upstream side U, the suction port 52 that opens downward in the vertical direction Dv, and includes, on the downstream side L, the discharge port 58 that opens downward in the vertical direction Dv.

As illustrated in FIG. 1, the discharge volute 57 of the present embodiment is provided such that a part of the discharge volute 57 provided in the upper half wall portion 370 of the upper half casing 300 expands inward in the axis line direction Da relative to a position on an extension line of the diffuser flow path 54 that causes the high-pressure gas to flow into the discharge volute 57. The position on the extension line of the diffuser flow path 54 corresponds to a position on an extension line of the flow of the process gas flowing out from the flow path of the impeller 4 in a last stage.

Further, a part of the discharge volute 57 provided in the lower half wall portion 270 is also provided so as to expand inward in the axis line direction Da relative to a position on an extension line of the preceding diffuser flow path 54.

As with the comparative example of FIG. 3 and FIG. 4, when the discharge volute 57 is provided so as to expand outward in the axis line direction Da relative to the position of the extension line of the diffuser flow path 54, a side wall 101L (including inclined surface 374) of the casing 101 on the downstream side L is located on the downstream side L as compared with the side wall 101L in the present embodiment (FIG. 1), because of outward expansion of the discharge volute 57. Accordingly, if the through bolt 430 is provided at an insertion position B near the wall surface 375 of the upper half casing 300 illustrated in FIG. 3, the through bolt 430 interferes a peripheral edge part of the discharge port 58 provided in the lower half casing 200. Accordingly, it is necessary to use other fastening member (such as embedded bolt) in place of the through bolt 430, or it is necessary to set the insertion position at a position separated on the downstream side L from the insertion position B in FIG. 3. In the latter case, the side wall 101L is located on the downstream side L of the casing 101 as compared with the configuration illustrated in FIG. 3, and the length of the rotary shaft 3 is accordingly increased.

In contrast, in the present embodiment in which the discharge volute 57 is provided so as to expand inward in the axis line direction Da, even in a case where the insertion position B is set to a position near the inclined surface 374 connecting the upper outer peripheral portion 371 and the pedestal 372, the through bolt 430 does not interfere the peripheral edge part of the discharge port 58 provided in the lower half casing 200 when the through bolt 430 is inserted into the through hole 440 as illustrated in FIG. 1. Therefore, it is possible to adopt the through bolt 430 as a bolt to be inserted into the through hole 440, which avoids increase of the length of the rotary shaft 3. Since the rotary shaft 3 is made shorter than that in the comparative example, it is possible to sufficiently secure rigidity of the rotary shaft 3, and to downsize the casing 101 by reducing the diameter of the rotary shaft 3 while securing rigidity.

The fixing portion 400 fixes the lower half casing 200 and the upper half casing 300 so as to form the accommodating space while the upper half flange portion 310 and a flange surface similarly provided in the lower half casing 200 are in contact with each other.

The fixing portion 400 according to the present embodiment includes a first fixing portion. The first fixing portion includes insertion holes 420 provided in the upper half flange portion 310, fixing holes provided in the lower half flange portion 210 similar to the insertion holes 420, and stud bolts 410 that are screwed into the fixing holes while being inserted into the insertion holes 420. The stud bolt 410 indicates a bolt threaded at both ends.

Further, the fixing portion 400 according to the present embodiment includes a second fixing portion. The second fixing portion includes the through hole 440 provided in the pedestal 372, a through hole provided in the lower outer peripheral portion 271 of the lower half casing 200, the through bolt 430, and a nut 450. The through hole provided in the lower outer peripheral portion 271 is provided at a position matched with the position of the through hole 440 when the upper half casing 300 is combined with the lower half casing 200. The through bolt 430 is inserted into these through holes.

As illustrated in FIG. 1, a position of a seat surface 431 of the pedestal 372 at which the fixed through bolt 430 is located, is higher than a position of a seat surface 411 of each of the stud bolts 410. The thickness of the upper half casing 300 is secured by the height of the seat surface 431.

More specifically, as described above, the inclined surface 374 gradually inclines more towards the axis line O from the upstream side U toward the downstream side L. Accordingly, when the stud bolts 410 are disposed near the inclined surface 374 such that the height position of the seat surface 431 of the through bolt 430 is substantially equal to the position of the seat surface 411 of each of the stud bolts 410, it is necessary to form a part of the inclined surface 374 in a recessed shape in order to secure a place where a head of the through bolt 430 is positioned. As a result, the thickness of the upper half casing 300 is reduced.

In contrast, as the position of the seat surface 431 of the through bolt 430 is higher than the position of the seat surface 411 of each of the stud bolts 410, it is possible to position the head of the through bolt 430 at a desired position without shaping a part of the inclined surface 374 in a recessed shape.

In a case where a stud bolt is used as the bolt to be inserted into the through hole 440 of the second fixing portion, the fastening force is difficult to be distributed, the surface pressure becomes high around the bolt, and the surface pressure may not be secured up to end parts of a mating surface of the upper half flange portion 310 and the end parts of a mating surface of the lower half flange portion 210 corresponding to the upper half flange portion 310. As the through bolt 430 is adopted, however, the fastening force of the through bolt 430 is widely distributed, and the surface pressure is secured up to the end parts of the mating surfaces of the upper half flange portion 310 and the lower half flange portion 210.

The seal housing holder 500 is provided on each of one side and the other side of the accommodating space in the axis line direction Da. The sealing device 6 (FIG. 1) is fixed inside the seal housing holder 500. The seal housing holder 500 includes a cylindrical shape around the axis line O. The rotary shaft 3 is inserted into the seal housing holder 500 in a state where the sealing device 6 is held inside the seal housing holder 500. The seal housing holder 500 is fixed to the lower half casing 200 and the upper half casing 300 through the sealing member 600.

The sealing member 600 seals a space between the lower half casing 200 and the seal housing holder 500 and a space between the upper half casing 300 and the seal housing holder 500. The sealing member 600 is provided on an outer peripheral surface of the seal housing holder 500 on the outside in the radial direction, and is in contact with the inner peripheral surface of the upper half small-diameter recess 352 and an inner peripheral surface of a similar recess provided in the lower half casing 200. The sealing member 600 of the present embodiment is an O-shaped ring.

In the present embodiment, the upper half casing 300 is placed, from above in the vertical direction Dv, on the lower half casing 200 on which the rotor 2 and the diaphragm group 5 have been placed. In this state, the stud bolts 410 are respectively inserted into the insertion holes 420 of the upper half casing 300, and front end (lower end) parts of the stud bolts 410 are respectively screwed into the fixing holes of the lower half casing 200. Further, the through bolt 430 is inserted into the through hole 440 of the pedestal 372, and the nut 450 is screwed to a thread part of the penetrating through bolt 430. As a result, the centrifugal compressor 1 that includes the casing assembly 100 and the rotor 2 disposed inside the casing assembly 100 is assembled.

[Effects]

Effects achieved by the centrifugal compressor 1 according to the present embodiment are described below.

When the centrifugal compressor 1 is operated, the high-pressure process gas flows to cause large pressure in the space in which the diaphragm group 5 and the like are disposed. According to the centrifugal compressor 1, it is possible to prevent leakage of the process gas from a space between the lower half casing 200 and the upper half casing 300 even if such large pressure occurs.

Further, in addition to the pressure problem, the division surfaces may be separated due to temperature rise that accompanies pressure rise of the process gas. For example, when the centrifugal compressor 1 is used for a nitric acid plant, the process gas at about 50° C. is raised to about 200° C. along with the pressure rise. Therefore, in the casing 101, temperature difference occurs between the upstream side U and the downstream side L of the process gas. According to the centrifugal compressor 1, however, it is possible to avoid thermal deformation due to such temperature difference and to prevent occurrence of separation of the division surfaces of the upper half casing 300 and the lower half casing 200.

The centrifugal compressor 1 according to the present embodiment includes the following characteristic configuration in order to prevent leakage of the high-pressure gas from the inside of the casing.

First, the part of the discharge volute 57 provided in the upper half casing 300 and the part of the discharge volute 57 provided in the lower half casing 200 are both provided so as to expand inward in the axis line direction Da. This makes it possible to provide the side wall 101L (side wall of each of upper half wall portion 370 and lower half wall portion 270) of the casing 101 having the thickness corresponding to necessary rigidity, to be receded on the inside in the axis line direction Da as much as possible on the downstream side L.

Since the side wall 101L defining the discharge volute 57 is provided to be receded on the inside in the axis line direction Da, it is possible to set the position of the bolt that is used to assemble the lower half casing 200 and the upper half casing 300 near the sealing device 6 on the downstream side L, to a position on the inside in the axis line direction Da, relative to the position of the insertion hole 420L in the comparative example (FIG. 4) in which the discharge volute 57 is provided so as to expand outward in the axis line direction Da. In addition, since the side wall 101L is not present at the position of the insertion hole 420L, it is possible to bring the position of the bolt close to the axis line O, that is, it is possible to set the position of the bolt to a position on the inside in the width direction Dw relative to the position of the insertion hole 420L in the comparative example (FIG. 4).

In order to secure necessary thickness of the side wall 101L even though the bolt is provided, the pedestal 372 that is higher in height than the upper half flange portion 310 is provided, and the pedestal 372 and the lower half wall portion 270 are fastened by the through bolt 430.

Using the through bolt 430 makes it possible to widely distribute fastening force and to secure surface pressure up to the end parts of the mating surfaces of the upper half flange portion 310 and the lower half flange portion 210. This allows for securement of high sealing property. In addition, the through bolt 430 causes the fastening force to act near inner ends of the division surfaces (flanges), as compared with the fastening position (420L) in the comparative example (FIG. 4). This sufficiently contributes to prevention of separation of the division surfaces.

Accordingly, the centrifugal compressor 1 makes it possible to more reliably suppress leakage of the high-pressure fluid such as working fluid flowing inside.

Hereinbefore, the embodiment of the present invention has been described in detail with reference to drawings; however, the configurations and the combinations thereof in the above-described embodiment are illustrative, and addition, omission, substitution, and other modification of the configurations may be made without departing from the scope of the present invention. Further, the present invention is not limited by the embodiment and is limited only by Claims.

In the above-described embodiment, the through bolt 430 is provided on each of the paired pedestals 372 and 372 located on both sides in the width direction Dw, that is, is provided at each of two positions in total. The number of through bolts 430, however, is not limited thereto, and a plurality of through bolts 430 may be provided on one pedestal 372 in order to sufficiently suppress leakage of the process gas.

Further, the centrifugal compressor 1 has been described as an example of the rotary machine in the above-described embodiment; however, the rotary machine is not limited thereto. For example, the rotary machine may be a supercharger or a pump.

REFERENCE SIGNS LIST

1 Centrifugal compressor (rotary machine)
2 Rotor
3 Rotary shaft
4 Impeller
5 Diaphragm group
51 Diaphragm
51A, 51B Member
52 Suction port
53 Suction flow path
54 Diffuser flow path
55 Curved flow path
56 Return flow path
57 Discharge volute
58 Discharge port
6 Sealing device
100 Casing assembly
101 Casing
101L Side wall
101W Inner wall
200 Lower half casing
210 Lower half flange portion
253 Lower half step surface
270 Lower half wall portion
271 Lower outer peripheral portion
273 Lower bearing accommodating portion
300 Upper half casing
310 Upper half flange portion
311 First upper half flange part
312 Second upper half flange part
350 Upper half accommodating recess
351 Upper half large-diameter recess
352 Upper half small-diameter recess
353 Upper half step surface
370 Upper half wall portion
371 Upper outer peripheral portion
372 Pedestal
373 Upper bearing accommodating portion
374 Inclined surface
375 Wall surface
376 Wall surface
400 Fixing portion
410 Stud bolt (first fixing portion)
411 Seat surface
420, 420L Insertion hole (first fixing portion)
430 Through bolt (second fixing portion)
431 Seat surface
440 Through hole (second fixing portion)
450 Nut (second fixing portion)
500 Seal housing holder
600 Sealing member
O Axis line
Da Axis line direction
Dr Radial direction
Dv Vertical direction
Dw Width direction

The invention claimed is:

1. A rotary machine, comprising:
a casing;
a rotor that includes a rotatable rotary shaft located inside the casing, and a plurality of stages of impellers fixed to an outer periphery of the rotary shaft;
a diaphragm group including diaphragms that are respectively provided in the plurality of stages of the impellers;
gas flow paths through which process gas to be compressed flows, the gas flow paths being provided respectively corresponding to the impellers; and
a discharge volute connected to the gas flow paths,
wherein
the discharge volute is provided to expand inward in an axis line direction of the casing,
the casing includes an upper half casing and a lower half casing,
the upper half casing includes:
an upper half flange portion;
an upper outer peripheral portion connected to the upper half flange portion; and
a pedestal that is:
adjacent to an end surface of the upper outer peripheral portion, on a downstream side of the upper outer peripheral portion, in the axis line direction, wherein the pedestal and the end surface of the upper outer peripheral portion are provided on the downstream side of the discharge volute, and
higher in height than the upper half flange portion,
the lower half casing includes:
a lower half flange portion; and a lower outer peripheral portion connected to the lower half flange portion, the upper half flange portion and the lower half flange portion are fixed by a first fixing portion, and the pedestal and the lower outer peripheral portion are fixed by a second fixing portion.

2. The rotary machine according to claim 1, wherein the discharge volute expands inward in the axis line direction, relative to a position on an extension line of a flow of the process gas flowing out from the impeller in a last stage.

3. A rotary machine according to claim 1, wherein the first fixing portion fixes the pedestal and the lower outer peripheral portion by a through bolt.

4. A rotary machine according to claim 1, wherein the first fixing portion fixes the upper half flange portion and the lower half flange portion by a stud bolt.

5. The rotary machine according to claim 4, wherein a position of a seat surface of the through bolt that fixes the pedestal and the lower outer peripheral portion is higher than a position of a seat surface of the stud bolt.

6. The rotary machine according to claim 3, wherein the first fixing portion fixes the upper half flange portion and the lower half flange portion by a stud bolt.

7. The rotary machine according to claim 6, wherein a position of a seat surface of the through bolt that fixes the pedestal and the lower outer peripheral portion is higher than a position of a seat surface of the stud bolt.

* * * * *